US008369544B2

(12) United States Patent
Andersen

(10) Patent No.: US 8,369,544 B2
(45) Date of Patent: Feb. 5, 2013

(54) MICROPHONE COMPONENT AND A METHOD FOR ITS MANUFACTURE

(75) Inventor: Bjoern Knud Andersen, Struer (DK)

(73) Assignee: 3M Innovative Properties Company, St. Paul, MN (US)

( * ) Notice: Subject to any disclaimer, the term of this patent is extended or adjusted under 35 U.S.C. 154(b) by 1409 days.

(21) Appl. No.: 10/573,875

(22) PCT Filed: Sep. 29, 2004

(86) PCT No.: PCT/DK2004/000658

§ 371 (c)(1),
(2), (4) Date: Oct. 28, 2008

(87) PCT Pub. No.: WO2005/032212

PCT Pub. Date: Apr. 7, 2005

(65) Prior Publication Data

US 2009/0052699 A1 Feb. 26, 2009

(30) Foreign Application Priority Data

Sep. 29, 2003 (DK) ..... 2003 01412

(51) Int. Cl.
*H04R 25/00* (2006.01)
*H04R 9/08* (2006.01)
*H04R 31/00* (2006.01)

(52) U.S. Cl. ..... 381/173; 381/361; 29/594

(58) Field of Classification Search ..... 381/173, 381/361, 365, 113, 114, 190, 191; 29/594
See application file for complete search history.

(56) References Cited

U.S. PATENT DOCUMENTS

| | | | | |
|---|---|---|---|---|
| 4,607,145 | A | 8/1986 | Ravinet et al. | |
| 6,414,397 | B1 * | 7/2002 | Sawamoto | 257/783 |
| 6,813,815 | B2 * | 11/2004 | Namerikawa et al. | 29/25.35 |
| 2003/0068059 | A1 * | 4/2003 | Blok et al. | 381/361 |

FOREIGN PATENT DOCUMENTS

| | | | |
|---|---|---|---|
| JP | 55074198 | U | 5/1980 |
| JP | 62014897 | U | 1/1987 |
| JP | 05273983 | | 10/1993 |

* cited by examiner

*Primary Examiner* — Curtis Kuntz
*Assistant Examiner* — Sunita Joshi
(74) *Attorney, Agent, or Firm* — Kevin W. Weber

(57) ABSTRACT

A microphone component that may be used in many types of enclosures for making contact with a living body for picking up body sounds. Piezoelectric transflexural diaphragm elements (3, 5, 6) are known; however, they are only useful as microphone elements when the manner of creating electrical contact does not influence their mechanical properties. A microphone component has been developed, which is both rugged and amenable to very inexpensive manufacture. This is obtained using a laminated construction in which a special layer is placed between the piezoelectric transflexural diaphragm element and the electrical interface element.

14 Claims, 3 Drawing Sheets

MICROPHONE COMPONENT AND A METHOD FOR ITS MANUFACTURE

Figure 2:
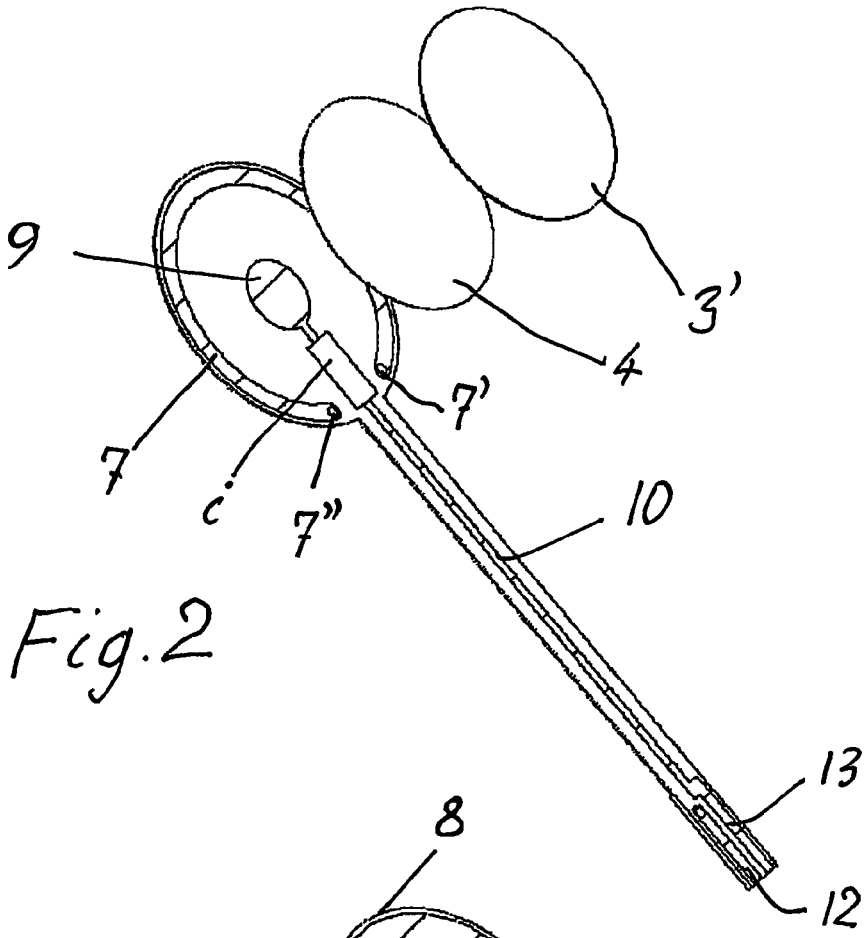

The invention relates to a microphone component comprising a piezoelectric transflexural diaphragm element and a signal interface element.

A microphone for airborne sound is usually protected by being enclosed in a housing with a protective grille. This creates difficulties in coupling the vibrations of the skin to the diaphragm when a microphone of the construction outlined above is used for pickup of bodily sounds. This is only one of the reasons many of the traditionally known methods of microphone construction are not applicable for this use. It is hence a purpose of the invention to provide a microphone component that is particularly suited for the pickup of bodily sounds from a human or animal body.

A microphone is usually regarded as an expensive transducer with a long service life. In case it is used in disposable applications, such as in surgery, where sterilization is required, this is normally solved by enclosing the microphone in a disposable sleeve, which is discarded after use. However, this approach requires surgical assistants to handle small items at a time where their attention could potentially be required for more urgent matters. There would hence be a need for a disposable microphone, and this is a further purpose of the invention.

Microphones are known in which the transducing element is a compound diaphragm giving an electrical output when exposed to bending. This may be obtained in the form of what has been termed a piezoelectric transflexural diaphragm, which is in fact a very thin piezoelectric layer, one side of which is usually bonded to a metal diaphragm and which has a metal layer deposited on the other side. The diameter of the metal diaphragm is larger than the diameter of the piezoelectric layer. This laminate reacts to shear stresses in the piezoelectric layer occurring when the diaphragm is bent inwards and outwards by generating a voltage difference between the metal diaphragm and the metal deposit.

Normally, the connection to a transfexural diaphragm element is performed by spot welding or soldering to the metal diaphragm and soldering to the metal layer, in particular in those applications where the transflexural diaphragm element is used as a piezo-buzzer. When the transflexural diaphragm element is used as an input device it is very important that electrical noise signals are not injected in the circuit, and this can only be obtained by keeping the connecting leads very close together. Furthermore, the high-impedance piezoelectric element itself should be enclosed in a Faraday's cage. In applications where it is important to have a disposable or one-time-use unit, the manufacture of such units must be in volume, with as small cycle-times as possible. In such circumstances, operations such as soldering, cutting to specific lengths, insulating, and connecting the other end of the connecting wires to the interface leads must be regarded as very time-consuming, and this traditional method of manufacture does not ensure that the closeness of the leads is maintained. It is a further object of the invention to provide an efficient method for the manufacture of such a microphone component.

It has been determined that for a wide range of applications, the essential part is indeed a microphone component comprising a piezoelectric transflexural diaphragm element and a signal interface element, and said component may be placed in many housings, and have many means of protecting the sensitive elements without compromising the stability and sensitivity of the completed microphone.

The above objects are fulfilled in a microphone component according to the invention, which is particular in that the signal interface element is a flexible printed circuit with a stiffness below that of the piezoelectric transflexural diaphragm element, and that the electrical and mechanical connection between the signal interface element and the piezoelectric transflexural diaphragm element is made in a material whose electrical resistance is negligible with respect to the output resistance of the piezoelectric transflexural diaphragm element and whose stiffness is below that of the signal interface element while being able to bond the signal interface element and the piezoelectric transflexural element to each other. The printed circuit makes contact to the side of the piezoelectric transflexural diaphragm element where there is access to both the metal diaphragm and the metallization, and as the metal diaphragm is connected to ground while the connection to it occurs all the way round its periphery, the piezoelectric element is effectively inside a Faraday's cage. The leads are taken from the diaphragm element while in close proximity, preferably because they are on either side of a double-sided flexible print.

Hereby there is obtained a structure that permits the transflexural diaphragm element to perform as a transducer without a noticeable influence from the required signal interface element, in particular because the electrical connections are simultaneously mechanical connections that display a hinge-like quality: they do not hamper the bending of the transflexural diaphragm element.

If it is desired, the electrical and mechanical connection may be obtained by soldering a central connecting element and a ring-shaped connecting element between the signal interface element and the piezoelectric transflexural element, both connecting elements being made unable to transmit bending forces.

The piezoelectric transflexural diaphragm element is a high-impedance element, and a series resistance of up to about 100 ohms in the connection is easily absorbed. For this reason it has been determined that it is feasible to establish a connection between the printed circuit and the appropriate locations on the piezoelectric transflexural diaphragm element by means of conductive tape. Traditionally, this would have been in the form of cut-outs corresponding to the areas of contact, but in the present invention use is made of an anisotropic conductive tape, which is only conductive along its thickness, and hence the whole area of the piezoelectric transflexural diaphragm element may be covered without detriment to its electrical performance, and it may actually improve its acoustical performance. Hence, in a preferred embodiment, the electrical and mechanical connection is obtained by means of an anisotropic conducting polymer layer. Such polymer layers are known in the form of a mounting and contacting tape or in a dispersion form that may be cured after application. Such anisotropic polymers are constituted of a polymer matrix, in which are effectively floating conducting miniature spheres, such as metallized glass spheres. When used, the thickness of a layer of this type is commonly no more than the diameter of the spheres, however the distance between spheres is commonly in the order of 10 times the diameter of the spheres. This, effectively, is what provides the anisotropic character of this unidirectionally conducting layer.

The combined effect of using a flexible printed circuit and an anisotropic conductive tape or cement is preferred over more classical connection methods for reasons of EMC shielding, as well as for reasons of mechanical homogeneity. The uniform application of the forces required to maintain electrical contact ensures that mechanical stresses are equally distributed over the sensor which assists in controlling acoustic distortion and ensures optimal mechanical robustness.

It has been determined that a microphone component being constituted of the above elements may be supplied with further elements that provide it with further properties. For instance, it may be prepared with a view to fixing to a rigid surface or with protective elements already fitted before putting the microphone component into a suitable housing. In accordance with this further advantageous embodiments have been indentified.

In order to fix the microphone component to a rigid surface while retaining its sensitivity, an advantageous embodiment is particular in that it is provided with a resilient layer on at least one of its sides. Providing such a cushion-type layer on both sides will assist in fixing the microphone component in a housing.

In order to provide the microphone component with protection against sharp objects, which might provoke a cracking of the piezoelectric layer a further embodiment is particular in that a mechanically protective front surface is an elastic disc of the same diameter as the piezoelectric transflexural diaphragm element, the supporting layers between said disc and said piezoelectric transflexural diaphragm element comprising a resilient layer.

The elastic disc is preferably at the same time a stiff disc, and it has surprisingly turned out that even hitting a corner of an object to the degree of indenting the disc visibly will not crack the piezoelectric transflexural diaphragm element. This is attributable to the force distributing qualities of the supporting resilient material which preferably is a foam material.

The microphone component according to the invention may be placed in any cavity in a carrier body commensurate with the dimensions of the microphone component. It is in accordance with its principle of working that it is supported by a ring-shaped step in a hole, however the provision of a resilient material on the reverse side of the piezoelectric transflexural diaphragm element will enable it to function also in a simple, cylindrical cavity (in the case of a circular element).

In an advantageous embodiment of the invention the printed circuit additionally carries an impedance converting semiconductor component. This means that the signal wires are less susceptible to electric noise. The semiconductor component, which may be a small integrated circuit, may be provided with power by a phantom circuit.

An advantageous extension of the idea of the invention is particular in that several piezoelectric transflexural diaphragm elements are connected by one and the same structure consisting of anisotropic tape and a flexible printed circuit. The printed circuit will provide individual signal connections and also individual impedance converters as required. This will inter alia permit the use of a diversity reception type selection of the best signal receiver at any one instant.

Figure 1:
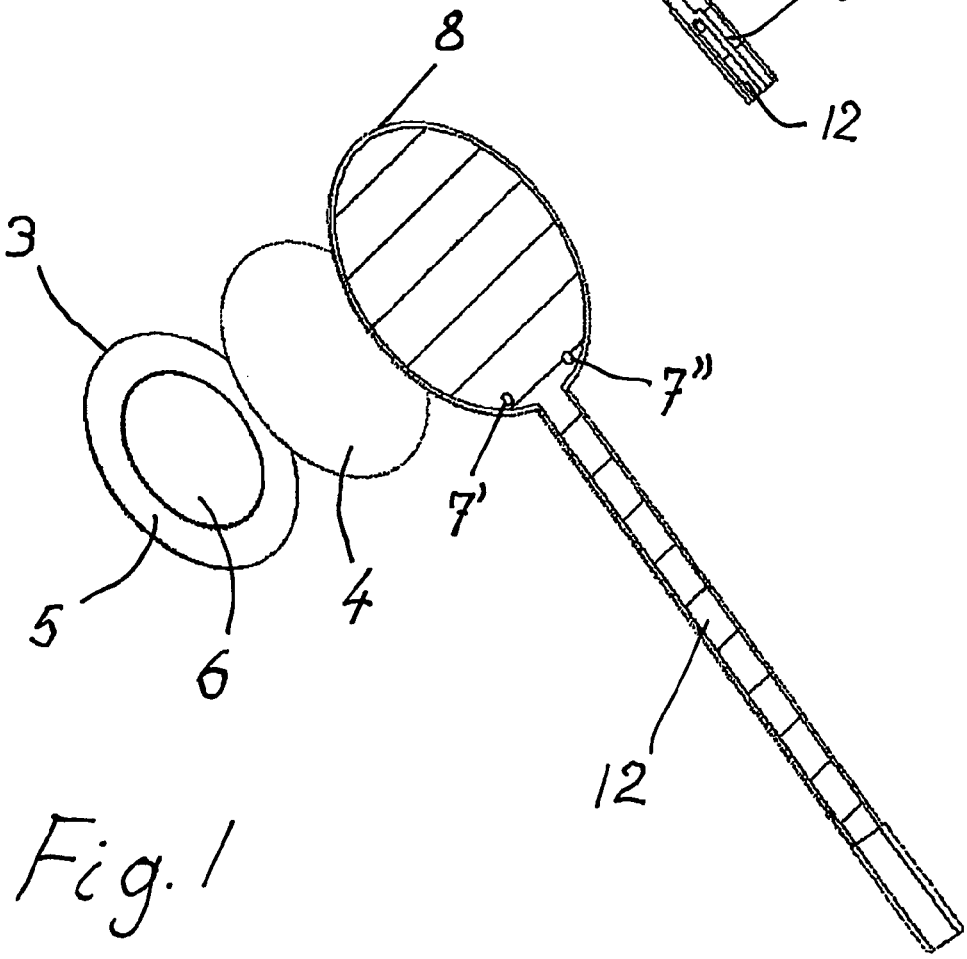
Figure 3:
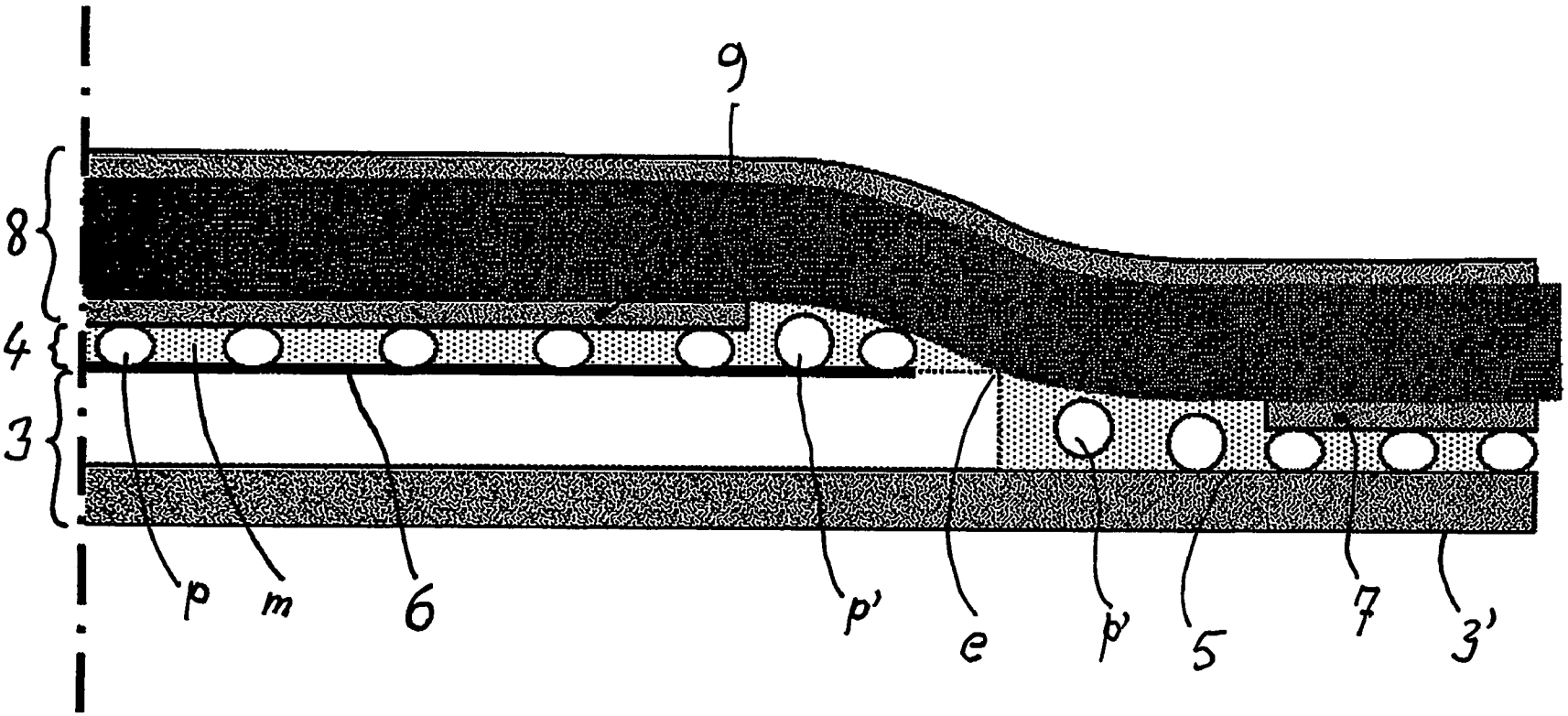
Figure 4:
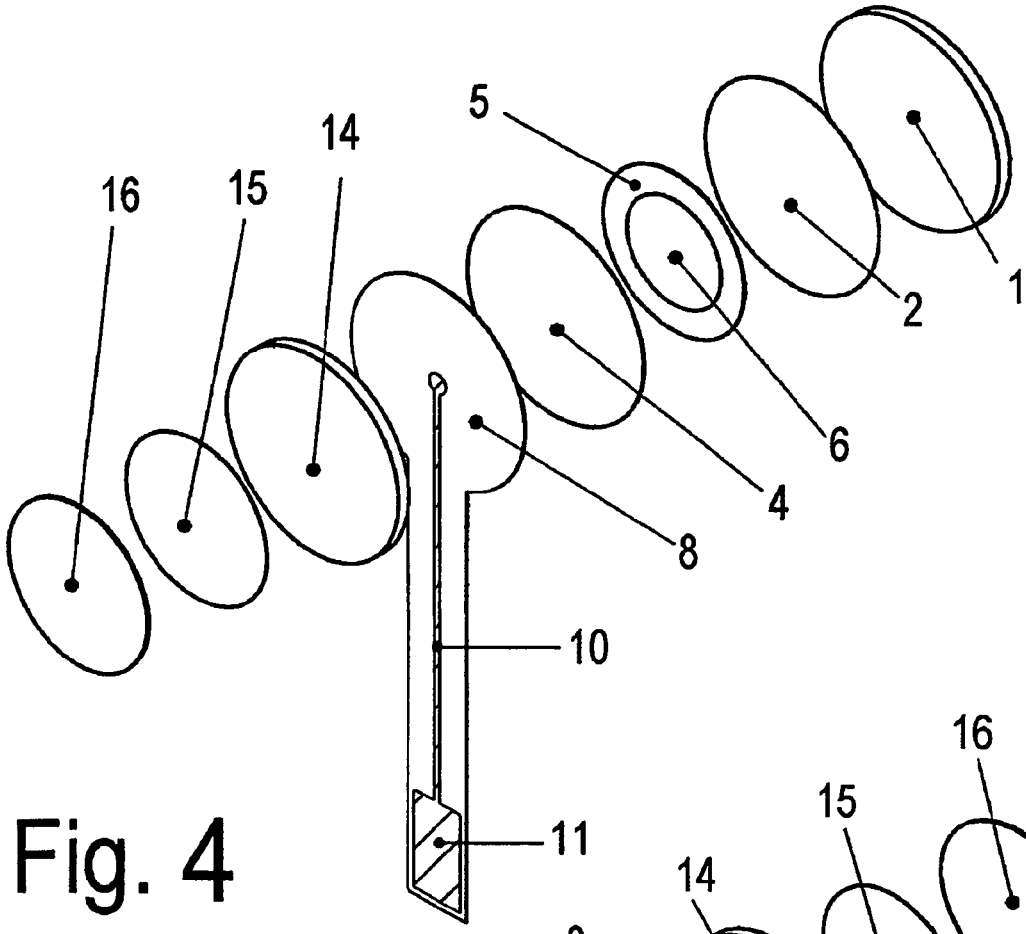
Figure 5:
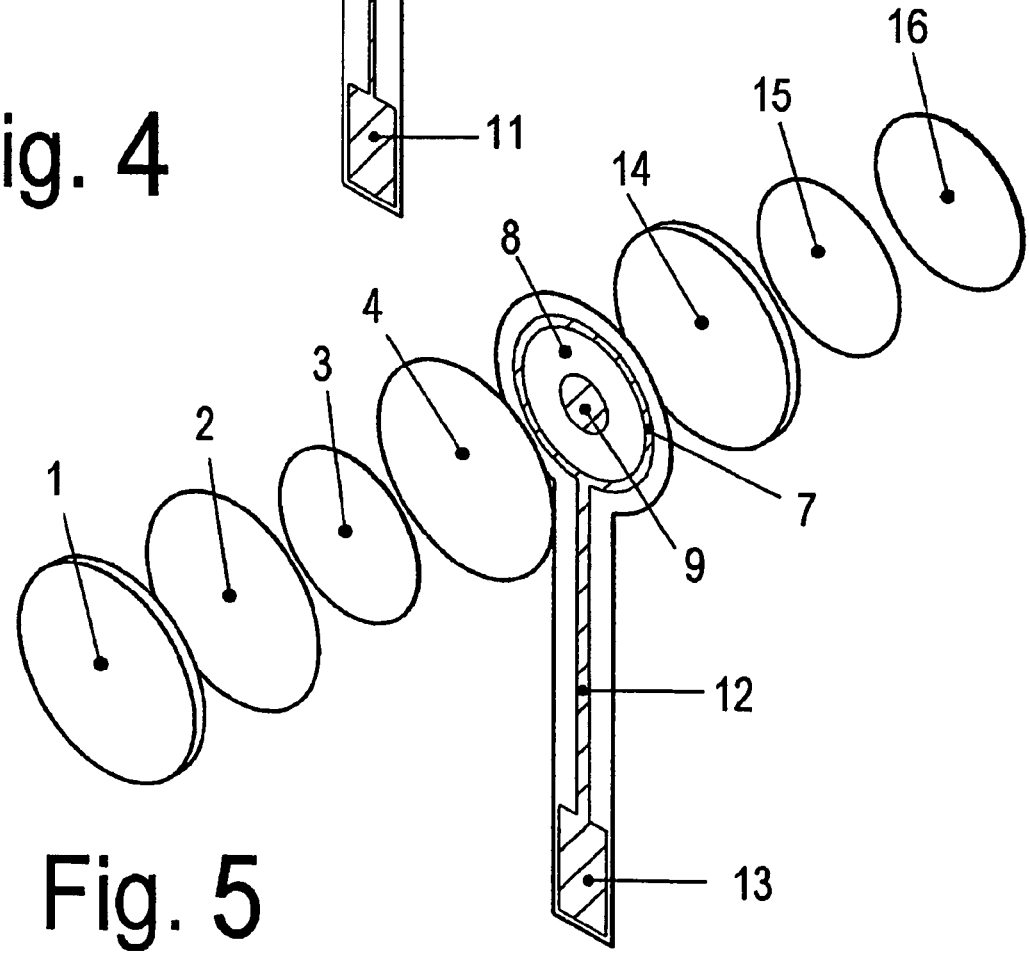

The invention will be described in greater detail with reference to the drawing, in which FIG. 1 shows an exploded view of a microphone component according to an embodiment of the invention and seen from the back, FIG. 2 shows an exploded view of the same embodiment from the front, FIG. 3 shows the principle of interfacing by means of an anisotropic polymer, FIG. 4 shows an exploded view of a microphone component according to another embodiment of the invention and seen from the front, and FIG. 5 shows an exploded view of a microphone component according to the same embodiment of the invention and seen from the back.

In FIG. 1 the elements of the microphone component are shown, in the embodiment shown consisting of a piezoelectric transflexural diaphragm element 3 that displays the naked metal diaphragm 5 surrounding the metallized surface 6 of the piezoelectric layer. On top of this is placed an anisotropic conductive and adhesive tape 4 that connects the two "terminals" 5 and 6 of the element 3 to the interface element 8. The interface element 8 is in the form of a flexible double-sided printed circuit, as is apparent from FIG. 2. It has a peripheral conducting part 7 and a central conducting part 9 that establish contact perpendicular to the surface of the printed circuit board by means of the circular anisotropic tape 4. The ring 7 constitutes electrical ground, which means that the metal front surface of the diaphragm 3 is also at ground potential. The electrical connection to the ring 7 is established by means of two plated-through holes 7', 7" in the flexible printed circuit, and the reverse of the circular part of the interface element 8 is completely metallised and at electrical ground level, which means that the piezoelectric element is completely shielded in metal at ground potential. In order to avoid that the conductor 10 leading from the central conducting part 9 short-circuits the piezoelectric element, a thin insulating layer i is provided in the area between the two through-plated holes 7' and 7".

The connection from the ground plane of the interface element 8 is constituted by a conductor 12 that takes the whole width of the flexible printed circuit strip and constitutes a ground plane in the connection, shielding the signal conductor 10 on the reverse side that is connected to the conducting part 9, because it is so much wider. At the end of the strip the two connections are brought onto the same side of the flexible printed circuit and shown as 12 and 13 in FIG. 2.

FIG. 3 shows the principle of the use of an anisotropically conducting polymer layer to establish electrical and mechanical contact in the assembly of a microphone component according to the invention. The drawing only shows the principle, and the dimensions are not to scale. The polymer may be in the form of a matrix designated m with dispersed conducting particles p in adhesive tape form or it may be a curable matrix. This layer is placed between the flexible printed circuit board 8 and the piezoelectric transflexural diaphragm element 3 in such a way that it establishes contact between the metal deposit 6 and the conductor 9 as well as between the metal diaphragm 5 and the conductor 7. The contact is both electrical and mechanical, using the adhesive properties of the layer. The metal deposit on the piezoelectric element does not reach all the way to the edge e, as shown in dotted lines, and there is a level difference between the parts 6 and 5, which both ensure that the anisotropy is functioning, and the two sides of the piezoelectric element are individually connected to the interface element. The ring 7 makes contact along most of the periphery of the piezoelectric transflexural diaphragm element 3 by means of the conductive particles p, and for this reason any gap between the interface element 8 and the piezoelectric transflexural diaphragm element 3 is filled by conducting material at ground level, whereby entry of disturbing electrical signals is eliminated.

In FIG. 4 are seen the elements of a microphone component according to another embodiment of the invention separate from the housing into which it is placed, preferably in such a way that the front of the microphone component is flush with the surrounding front surface of the housing. It is expedient to explain the present embodiment while describing the manner in which it may be assembled. All the elements are circular and are prepared before assembly. A foam pad 1 adheres to a double-sided adhesive tape 2 that attaches it to the all-metal side (see FIG. 4) of a piezoelectric transflexural diaphragm element 3. An anisotropic conductive tape 4 being adhesive on both sides establishes connection to the side of the piezoelectric transflexural diaphragm element 3 that displays the naked metal diaphragm 5 surrounding the metallized surface 6 of the piezoelectric layer. A conducting ring 7 (see FIG. 5) formed on a small circular printed circuit 8 is connected to the metal diaphragm via the anisotropic conductive tape, and the metallized surface is similarly connected to a centrally placed conductive pad 9 (see FIG. 5) on the printed circuit. In the present embodiment the pad is plated through a hole in the insulating material part of the printed circuit to the other side, where a printed conductor 10 on a tab takes the signal to a terminal 11 somewhat removed from the circular elements. Similarly, the conducting ring 7 has a printed conductor 12 placed precisely opposite the printed conductor 10 on the other side (see FIG. 4) and brought to a terminal 13. In this manner, electric contact has been established to the piezoelectric transflexural diaphragm element, and the conductor 12 corresponding to the metal diaphragm 5 will be considered the ground connection. The close proximity between the two conducting strips will ensure EMC. In a similar embodiment, the printed circuit is single-sided, and the ground connection is formed as a guard ring around the centrally placed conductive pad and is brought down on either side of the central conductor on the strip.

A foam pad 14 with one adhesive side is placed on the reverse side of the printed circuit 8, and a double-sided adhesive tape 15 adheres a stainless steel diaphragm 16 to the foam pad 14. The stainless steel has a typical thickness of 150 μm and forms the outer surface. The whole microphone component may be mounted in a cavity in the housing in two ways, bearing in mind that the intention of the embodiment described is to provide a single-use microphone component. One method is to provide the innermost foam pad 1 with an adhesive that is protected by a release slip to be removed before placing the microphone component in the cavity and pressing it to the bottom of the cavity. Another method is to provide a safety-pin-like clip placed diametrically across the protective stainless steel diaphragm 16. When the microphone component is to be replaced, the clip is opened, the used component is extracted by pulling the printed circuit strip, the new and sterile component is placed in the cavity, and the clip is closed. A clip of this kind will provide a ground connection to the protective stainless steel diaphragm 16, and thereby improve the screening of the piezoelectric transflexural diaphragm element.

In both the embodiments shown it is a simple matter to fit a pre-amplifier to the flexible printed circuit board just outside the circular part of the microphone component. Preferably it is soldered on the side comprising the conductor strip 10, in order that both the amplifier and the signal leads are shielded by means of the broader grounding strip 12 on the other side of the flexible printed circuit. Such an amplifier would typically be phantom-powered, and the output would be low-impedance. However, as long as the high-impedance part is well shielded, there is no problem in using a multi-conductor connection for the greater part of the strip part of the microphone component, which means that a DC connection can equally well be used for power supply.

All the elements are manufactured beforehand and assembly into one microphone component is extremely well adapted to automatic assembly. Essentially, the elements are centered (brought into register in order to become coaxial) and stacked in any order that provides a correct assembly, and simple stacking may be completed by pressing with a predetermined force in order to assure bonding between the various adhesive components.

The foregoing description of the specific embodiments will so fully reveal the general nature of the present invention that others skilled in the art can, by applying current knowledge, readily modify or adapt for various applications such specific embodiments without undue experimentation and without departing from the generic concept, and therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of forms without departing from the invention.

The invention claimed is:

1. A microphone component comprising:

at least one piezoelectric transflexural diaphragm element, a signal interface element comprising conductors, the signal interface element comprising a flexible printed circuit with a stiffness below that of the piezoelectric transflexural diaphragm element, a mechanically protective front surface, wherein the mechanically protective front surface is an elastic metal disc of essentially the same dimensions as the piezoelectric diaphragm element, and a supporting resilient layer disposed between the piezoelectric transflexural element and the elastic metal disc, wherein an electrical and mechanical connection between the signal interface element and the piezoelectric transflexural diaphragm element is made of a material having an negligible electrical resistance with respect to an output resistance of the piezoelectric transflexural diaphragm element, a stiffness below that of the signal interface element, and is able to bond the signal interface element and the piezoelectric transflexural element to each other.

2. A microphone component according to claim 1, wherein the material of which the electrical and mechanical connection is made is an anisotropic conducting polymer.

3. A microphone component according to claim 2, wherein the anisotropic conducting polymer is in the form of an anisotropic conducting adhesive tape.

4. A microphone component according to claim 3, wherein the anisotropic conducting polymer is a curable dispersion of conducting particles.

5. A microphone component according to claim 1, wherein the signal interface element is connected to the piezoelectric transflexural diaphragm element by means of a conductive adhesive tape patterned to correspond to terminal areas on the piezoelectric transflexural diaphragm element.

6. A microphone component according to claim 1, wherein the supporting resilient layer is comprised of an elastomeric foam pad.

7. A microphone component according to claim 6, and further comprising a second foam pad, wherein the second foam pad has an adhesive layer thereon that is protected by a removable cover, the foam pad being adapted to be removably fixed in a cavity after removal of said cover.

8. A microphone component according to claim 1, wherein the printed circuit carries at least one impedance converting component in proximity to the piezoelectric transflexural diaphragm element.

9. A microphone component according to claim 1, wherein said piezoelectric transflexural diaphragm element is one of a plurality of piezoelectric transflexural diaphragm elements, each of which is individually connected to terminals on the same printed circuit.

10. A microphone component according to claim 1, further comprising a clip attached across the elastic metal disc for removably fixing the microphone component in a cavity while simultaneously establishing an electrical ground connection to said disc.

11. A microphone component according to claim 1, wherein all of said elements are circular and coaxial.

12. A method for the manufacture of a microphone component comprising the steps of:

a)

b) centering a double-sided adhesive tape element on a metal disc, c) centering a first foam element on the double-sided adhesive tape element, d) centering a printed circuit on the first foam element with a conductor of the printed circuit facing the foam element, e) centering an anisotropic tape element on the printed circuit, f) centering a piezoelectric transflexural diaphragm element on the anisotropic tape element, establishing electrical contact to electrodes of the piezoelectric transflexural diaphragm element, g) centering a double-sided adhesive tape element on a metal back of the piezoelectric transflexural diaphragm element, and centering a second foam element on the double-sided adhesive tape element.

13. A method for the manufacture of a microphone component comprising the steps of:

a)

b) centering a first foam element on a double-sided adhesive tape element, c) centering the double-sided adhesive tape element on a metal back of a piezoelectric transflexural diaphragm element, d) centering the piezoelectric transflexural diaphragm element on an anisotropic tape element, establishing electrical contact to electrodes of the piezoelectric transflexural diaphragm element, e) centering the anisotropic tape element on a printed circuit, f) centering the printed circuit on a second foam element with a conductor of the printed circuit facing the second foam element, g) centering the second foam element on a double-sided adhesive tape element, and centering the double-sided adhesive tape element on a metal disc.

14. A microphone component comprising:

at least one piezoelectric transflexural diaphragm;

a signal interface element comprising conductors, the signal interface element comprising a flexible printed circuit;

an anisotropic conducting polymer coupling the signal interface element to the piezoelectric transflexural diaphragm and adapted to establish an electrical and mechanical connection therebetween;

an elastomeric foam coupled to the signal interface element; and an elastic metal disc of essentially the same dimensions as the piezoelectric diaphragm element, wherein said elastic metal disc is coupled to a surface of the elastomeric foam opposite the signal interface element.

* * * * *